US007168886B2

(12) United States Patent
Loader

(10) Patent No.: US 7,168,886 B2
(45) Date of Patent: Jan. 30, 2007

(54) METHOD AND APPARATUS FOR LAYING A TRAFFIC CALMING SURFACE

(75) Inventor: Stephen Loader, East Sussex (GB)

(73) Assignee: Prismo Limited (GB)

( * ) Notice: Subject to any disclaimer, the term of this patent is extended or adjusted under 35 U.S.C. 154(b) by 71 days.

(21) Appl. No.: 10/483,714

(22) PCT Filed: Jul. 11, 2002

(86) PCT No.: PCT/GB02/03204

§ 371 (c)(1),
(2), (4) Date: Jul. 22, 2004

(87) PCT Pub. No.: WO03/006743

PCT Pub. Date: Jan. 23, 2003

(65) Prior Publication Data

US 2005/0031412 A1 Feb. 10, 2005

(30) Foreign Application Priority Data

Jul. 13, 2001 (GB) ..... 0117165

(51) Int. Cl.
*E01C 7/00* (2006.01)

(52) U.S. Cl. ..... 404/75; 404/106; 404/119

(58) Field of Classification Search ..... 404/15, 404/75, 77, 79, 96, 106, 119
See application file for complete search history.

(56) References Cited

U.S. PATENT DOCUMENTS 1,265,404 A * 5/1918 Tuteur ..... 404/15
1,357,860 A * 11/1920 Freeman ..... 238/3
1,652,434 A * 12/1927 Abram et al. ..... 404/106
1,671,303 A 2/1928 McClure
2,185,020 A 12/1939 Vostrez
2,509,675 A 5/1950 Cox (Continued)

FOREIGN PATENT DOCUMENTS

EP 0898018 2/1999

(Continued)

OTHER PUBLICATIONS

U.K. Search Report for priority application GB0117165.1 (dated Nov. 9, 2001).

(Continued)

*Primary Examiner*—Gary S. Hartmann
(74) *Attorney, Agent, or Firm*—Fulwider Patton LLP; Scott R. Hansen

(57) ABSTRACT

The present application relates to methods for laying a traffic calming surface, in which molten material is deposited on the surface of a road or path and is then moulded so as to form a continuous, substantially sinusoidal profile which extends along the intended direction of travel. The profile can be formed by employing at least one pair of longitudinal rails which are positioned on the surface of the road so as to be spaced apart from each other and such that they are aligned with the intended direction of travel. The upper surface of the rails exhibits the required profile so that molten material deposited between the rails can be spread between the rails to form the required surface.

23 Claims, 5 Drawing Sheets

U.S. PATENT DOCUMENTS

| | | | | |
|---|---|---|---|---|
| 3,051,062 | A | 8/1962 | Apel et al. | |
| 3,234,862 | A * | 2/1966 | Suhr | 404/106 |
| 3,331,297 | A | 7/1967 | Bettino | |
| 3,872,601 | A * | 3/1975 | Burgin | 200/61.45 R |
| 3,874,806 | A | 4/1975 | Grist et al. | |
| 3,994,611 | A | 11/1976 | Sipkema | |
| 4,199,541 | A | 4/1980 | McFarland | |
| 4,397,626 | A | 8/1983 | Morrison | |
| 4,507,015 | A * | 3/1985 | Furukawa et al. | 404/102 |
| 4,575,278 | A | 3/1986 | Whitney | |
| 5,560,734 | A | 10/1996 | Lucas et al. | |
| 5,769,563 | A * | 6/1998 | Flynn | 404/15 |
| 5,971,656 | A * | 10/1999 | Kitsmiller | 404/74 |
| 6,014,595 | A | 1/2000 | Kobayashi et al. | |
| 6,050,744 | A * | 4/2000 | Binning | 404/108 |
| 6,287,048 | B1 * | 9/2001 | Hollon et al. | 404/84.2 |
| 6,315,492 | B1 * | 11/2001 | McIntosh | 404/17 |
| 6,358,621 | B1 * | 3/2002 | Hughes et al. | 428/489 |
| 6,520,715 | B1 * | 2/2003 | Smith | 404/75 |

FOREIGN PATENT DOCUMENTS

| | | |
|---|---|---|
| FR | 2575856 | 7/1986 |
| GB | 347328 | 4/1931 |
| GB | 909194 | 10/1962 |
| GB | 1512416 | 6/1978 |
| GB | 2121462 | 12/1983 |
| GB | 2316703 | 3/1998 |
| GB | 2332467 | 6/1999 |
| NL | 9200675 | 11/1993 |
| WO | WO 01/29322 | 4/2001 |

OTHER PUBLICATIONS

International Search Report for PCT/GB 02/03204 (dated Apr. 11, 2002).

* cited by examiner

METHOD AND APPARATUS FOR LAYING A TRAFFIC CALMING SURFACE

CROSS-REFERENCE TO RELATED APPLICATIONS

This is a national stage filing under 35 U.S.C. § 371 based on PCT/GB02/03204 filed 11 Jul. 2002, which claims priority from British Patent Application No. 0117165.1 filed 13 Jul. 2001.

BACKGROUND OF THE INVENTION

1. Field of the Invention

The present invention relates to a method and apparatus for laying a traffic calming surface which will alert vehicle drivers to hazards ahead by creating an audible and vibratory warning inside the vehicle.

2. Description of the Related Art

A number of traffic calming surfaces have been developed in order to alert drivers to approaching hazards, such as a junction or a pedestrian crossing, and serve to indicate to the driver that he should decelerate. Speed bumps have been widely used for a number of years and comprise a raised section which extends transversely relative to the intended direction of travel. In order to traverse the speed bump smoothly and safely, the speed of a vehicle must be reduced. A series of speed bumps positioned along a stretch of road will serve to ensure that the speed of vehicles moving along the road are regulated.

In more recent years, rumble areas/strips have been employed, particularly in rural areas, in an attempt to slow traffic approaching a potentially hazardous situation. The known rumble strips generally comprise a concrete, bituminous or synthetic surface overlay having a series of irregularities such as raised bars or an imprinted pattern of grooves. As a vehicle traverses the rumble strip, a range of vibrational frequencies are generated at the tyres which will be transmitted to the driver's cab. The vibrational effect of the strip will be felt and heard by the driver and will act as a warning that the driver should reduce his speed.

There are a number of techniques for laying these surfaces which involve, for example, a means for pressing a series of ribs onto the road surface, or embossing processes which comprise laying a molten material and impressing a pattern of grooves into the upper surface of the material.

Rumble strips were originally developed in the 1970's as a traffic calming surface for use primarily in rural areas. At that time, little thought was given to the external noise disturbance generated as vehicles traversed the strips when the surface was designed. One of the main disadvantages of the rumble strips currently employed on the roads is that they generate considerable noise levels outside the vehicle which has a detrimental effect on the surrounding environment. This problem is compounded by increasing traffic volumes seen on the roads today. For these reasons, the environmental effects of introducing traffic calming surfaces into urban, residential and rural areas has become an issue. As a result of pressure imposed on Governments and local authorities by environmental agencies, there has been a considerable need to provide a means to slow traffic approaching hazardous areas, while minimising the consequential noise disturbance which may be experienced in the surrounding area. More recently, urban planners have also become interested in the need to develop a quieter means of controlling traffic.

INVENTION SUMMARY

According to one aspect of the present invention, there is provided a method of laying a traffic calming surface, the method comprising the steps of:

i) depositing molten material on the surface of a road or path;

ii) moulding the molten material such that the upper surface has a predetermined profile which extends along the intended direction of travel.

The profile can be formed in a number of ways and is preferably a continuous, substantially sinusoidal profile. One method of moulding the upper surface of the molten material involves the use of at least one pair of substantially longitudinal rails which can be positioned on the surface of the road so as to be spaced apart from each other and such that they are substantially aligned with the intended direction of travel. The upper surface of the rails exhibits the required profile which extends along the length of said rails and the rails are advantageously positioned on the road so as to be mutually parallel.

According to a second aspect of the present invention, there is provided an apparatus for use with a method of laying a traffic calming surface, the apparatus comprising at least one pair of longitudinal rails, the upper surface of which have a continuous, substantially sinusoidal, profile which extends along the length thereof.

Material is deposited between the rails, which are spaced apart by 500 mm to 4 m depending on the width of the road to be treated, and is then spread between them to form a traffic calming surface, the upper surface of which exhibits the predetermined profile. This is preferably achieved by means of a moveable member, or sled, which extends between the rails, and which is moved over the rails in contact with the molten material such that the upper surface of the material is moulded to form the profile.

According to a third aspect of the present invention, there is provided a moveable member for spreading molten material, the moveable member exhibiting or defining a substantially linear edge which comes into contact with said molten material, wherein the moveable member is moved over the material and is arranged to create a continuous, substantially sinusoidal, profile in the upper surface thereof.

Preferably, the moveable member defines or exhibits a substantially linear edge which extends between the pair of rails and comes into contact with the molten material as it is moved across the upper surface of the rails. Furthermore, the moveable member, which may or may not be heated to temperatures of between 300° C. to 550° C., preferably comprises a cylindrical drum which is advantageously formed of material, such as steel, which will not lose its shape through heating as it is important that the linear edge remains straight. The moveable member may be heated by a number of methods such as gas burners directed to the leading edge. Method embodying the present invention which do not heat the moveable member may advantageously use a suitable lubricant which will allow the material to be spread more easily with a cool edge.

The moveable member is preferably provided with at least one pair of runners which are designed to ride along the top of the profiled rails. This will result in the linear edge rising and falling to match the profile of the rails. It is also important to ensure that a sufficient volume of material is kept in front of the moveable member as it moves along the rails in order to ensure that a full and even profile is achieved.

According to a fourth aspect of the present invention, there is provided an apparatus for laying a traffic calming surface, comprising a means for moulding molten material so as to form a continuous, substantially sinusoidal profile in the upper surface thereof.

According to a fifth aspect of the present invention, there is provided an apparatus for laying a traffic calming surface, comprising:

i) at least one pair of longitudinal rails, the upper surface of which have a continuous, substantially sinusoidal, profile which extends along the length thereof, wherein molten material is deposited between said rails; and ii) a moveable member which extends between the rails, and which is moved over the rails in contact with the molten material such that the upper surface of the material is moulded to form a continuous, substantially sinusoidal, profile.

Alternatively, the material may be deposited between the rails and can be "tamped" into shape by means of a hand held tampering tool having a straight edge It is advantageous for the rails to be secured to the ground so as to ensure that they do not slip. Any slippage that does occur could have a detrimental effect on the resulting traffic calming surface. More than one pair of rails may advantageously be positioned on the existing road surface end to end. It is important to ensure that the rails are butted closely together as a gap on one side will result in an uneven profile being formed.

Other means of forming a continuous, substantially sinusoidal profile in the surface of the deposited molten material are also envisaged within the scope of the present invention. For example a moveable member mounted on a rolling means may be advantageously provided, wherein the moveable member exhibits or defines a substantially linear edge which extends across the width or a part of the width of the deposited material. The rolling means has a non central axis of rotation such that as the moveable member progresses with the linear edge in contact with the molten material, it rises up and down so as to form a the required profile in the upper surface of said molten material. The rolling means preferably comprises at least one pair of wheels.

Alternatively, a moulding member, the underside of which exhibits a continuous substantially sinusoidal profile, is pressed into the molten material after it has been deposited on the ground.

According to a sixth aspect of the present invention, there is provided a method of laying a traffic calming surface, wherein molten material is accommodated within a vessel, the vessel having a opening at or near the lower end thereof so that the molten material can flow out of the vessel, wherein the vessel is provided with a means to control the flow of material such that, in use, the material is deposited on the ground so as to form a traffic calming surface, the upper surface of which has a continuous, substantially sinusoidal, profile.

When the surface is applied according to methods embodying the present invention, care should be taken when butting a new strip alongside a previously laid strip to ensure that the profile peaks and troughs of the two strips match up. Preferably, longitudinal laying joints may be laid which do not detract from the aesthetics of the finished surface.

Preferably, the edge profile of the surface is such that it does not produce a trip hazard or prevent water from draining into gullies. This may advantageously be achieved by the tamping down of the profile to, or close to, the kerb edge. Furthermore, leading and trailing edges to the profiled surface may advantageously be laid which will produce a gentle incline for traffic to approach the surface. This incline may advantageously take traffic from the existing road surface to the height of the peak over a distance of between 3 m and 5 m.

Furthermore, the surface advantageously extends across the entire width of the road. However, narrow breaks in the traffic calming surface may be provided along the road edge for reasons of drainage or to serve as cycle paths.

Traffic calming surfaces which have been laid on an existing road surface according to embodiments of the present invention have been shown to generate significant interior noise and vibration which will act as a warning to the driver that he should reduce his speed. Trials have also shown that exterior noise disturbance, caused by vehicles traversing the surface, is substantially reduced as compared to the exterior noise arising from methods of traffic calming. Embodiments of the present invention are therefore envisaged to be particularly beneficial in calming traffic in urban, residential and rural areas.

This effect can be explained by consideration of the so called forcing frequencies generated as the tyres traverse the traffic calming surface. The forcing frequency is the frequency of an oscillating force at the tyre/profile interface generated as a consequence of the wheels being forced to follow the sinusoidal profile as it traverses the traffic calming surface. A series of discontinuities, such as raised slots or an imprinted pattern of grooves, will produce a number of pulses of vibration as a car traverses them, thereby generating a wide range of frequencies which will contribute to the overall noise disturbance. Loose fitting panels can also vibrate creating parasitic noise covering a wide range of frequencies. However, a sinusoidal profile will preferably only cause one main frequency of oscillation with few higher frequency harmonics.

Advantageously, the wavelength of the continuous sinusoidal profile is approximately equal to the contact patch length of a vehicle tyre. Furthermore, it is advantageous for the wavelength of the sinusoidal profile to be in the range 0.28 m to 0.48 m. Preferably, the wavelength of the sinusoidal profile is in the range 0.3 m to 0.4 m with the optimum wavelength being 0.35 m.

Preferred embodiments of the present invention have a peak to trough amplitude in the range 4 mm to 12 mm. Advantageously, the peak to trough amplitude is in the range 4 mm to 7 mm. The maximum deflection from the road surface is preferably 15 mm.

A traffic calming surface embodying the present invention may advantageously comprise a synthetic bitumen material such as that described in patent application No.: GB 9717549.1 (Imprint C), the disclosure of which in incorporated herein by way of reference thereto. This material comprises a synthetic bitumen formulated from binder resin, polymer and plasticiser, mixed with filler and aggregate and is particularly beneficial since it exhibits a number of advantageous properties. For example, the material may be applied to the road in a molten form and is readily moulded to the desired profile shape. Once moulded, the material is resistant to slump and is stiff enough to withhold traffic pressure but is resistant to cracking. Furthermore, as this material is generally pale in colour, it may be easily coloured by both light and dark pigments.

Alternatively, the traffic calming surface may comprise bitumen based materials such as asphalt, concrete or a polymer modified compound. Surfaces made from recycled molten tyres are also envisaged.

A traffic calming surface embodying the present invention may advantageously comprise a synthetic bitumen material such as that described in patent application No.: GB 9717549.1 (Imprint C), the disclosure of which in incorporated herein by way of reference thereto. This material comprises a synthetic bitumen formulated from binder resin, polymer and plasticiser, mixed with filler and aggregate and is particularly beneficial since it exhibits a number of advantageous properties. For example, the material may be applied to the road in a molten form and is readily moulded to the desired profile shape. Once moulded, the material is resistant to slump and is stiff enough to withhold traffic pressure but is resistant to cracking. Furthermore, as this material is generally pale in colour, it may be easily coloured by both light and dark pigments.

Alternatively, the traffic calming surface may comprise bitumen based materials such as asphalt, concrete or a polymer modified compound.

BRIEF DESCRIPTION OF THE DRAWINGS

For a better understanding of the present invention, and to show how the same may be carried into effect, reference will now be made, by way of example to the accompanying drawings in which.

DETAILED DESCRIPTION OF THE PREFERRED EMBODIMENTS

Figure 1A:
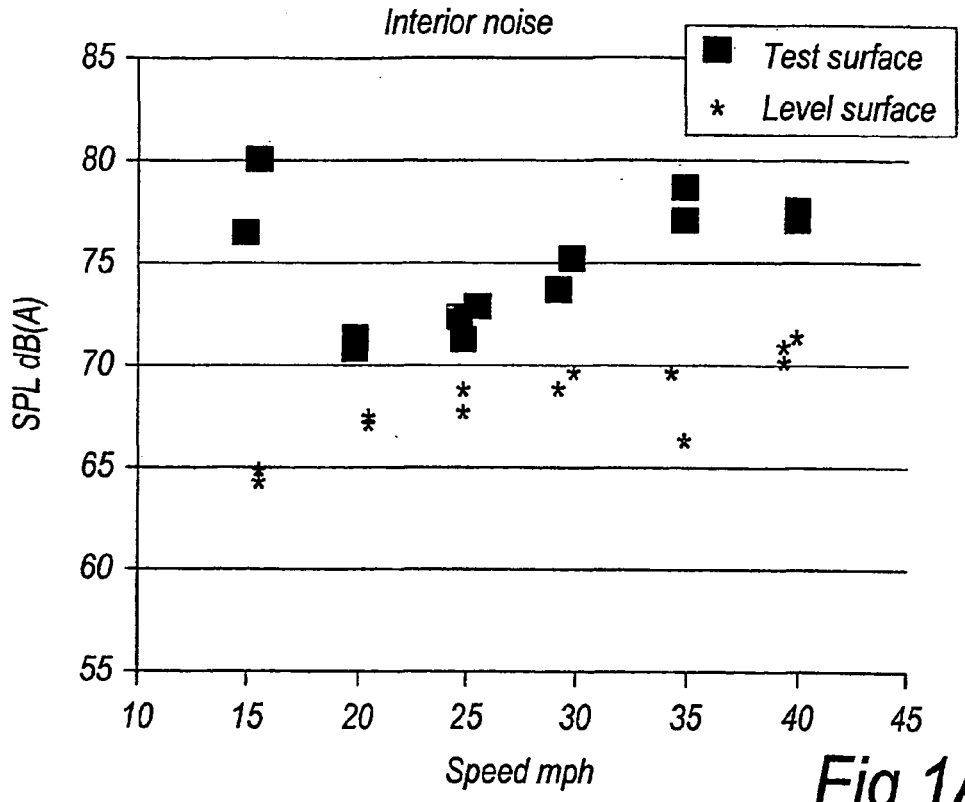
FIG. 1 illustrates interior noise and vibration levels experienced by a medium sized car traversing a traffic calming surface which has been laid according to embodiments of the present invention.

The dimensions of the continuous sinusoidal profile, such as wavelength and peak to trough amplitude, are advantageously chosen so as to achieve maximum transmission of tyre vibration into the driver's cab while minimising the exterior noise disturbance. There are a number of approaches which may advantageously be considered when seeking to achieve this. For instance, it is beneficial for the surface to cause significant horizontal vibrations in the vehicle suspension since, unlike vertical vibrations which are generally stifled by the vehicle suspension mechanism, horizontal vibrations are more readily transmitted to the driver's cab. Both the wavelength and the peak to trough amplitude will clearly have a significant effect on the level of horizontal vibrations generated, since these factors will govern the contact forces between the tyre and the sinusoidal surface.

Furthermore, the wavelength $\lambda$ (m) of the sinusoidal surface is directly related to the forcing frequency f (Hz) on the vehicle tyre, and the vehicle speed $v$ (m/s), according to the following relationship:

$$f = \frac{v}{\lambda} \text{ Hz}$$

The wavelength of the sinusoidal profile is preferably chosen such that the forcing frequency at the tyres of crossing vehicles will excite one, or a number of, resonant frequencies within the vehicle.

Advantageously, the wavelength of the sinusoidal profile is chosen such that a low forcing frequency will be generated at the tyres. The human ear is considerably less sensitive to low frequency vibrations and, at frequencies of around 35 to 40 Hz, will be 40 dB less sensitive than at 1 kHz where the sensitivity of the ear is approaching a maximum. Therefore, it is advantageous for the forcing frequency to be in the range 35 Hz to 40 Hz so that external noise disturbance is kept to a minimum. Unlike a continuous profile embodying the present invention, a series of humps or bars of similar dimensions to the continuous profile, will produce short duration impulsive forces at the tyres which theory shows can be resolved into a wide range of forcing frequencies. Some of these frequencies will be close to 1 kHz and will therefore be significantly more perceptible to the human ear.

The following table represents the variation in forcing frequency with wavelength of the sinusoidal profile in accordance with the above equation. The speed of the vehicle is assumed to be 30 mph (48 km/h), or 13.3 m/s, which is the speed limit in many residential areas:

| Profile Number | Wavelength (m) | Forcing frequency at 30 mph (Hz) |
|---|---|---|
| 1 | 0.05 | 267 |
| 2 | 0.13 | 103 |
| 3 | 0.35 | 37.0 |
| 4 | 0.92 | 14.5 |
| 5 | 4.41 | 3.02 |
| 6 | 0.28 | 47.6 |
| 7 | 0.43 | 31.0 |
| 8 | 0.35 | 27.8 |

The frequencies generated by profiles 1 to 5 span nearly two orders of magnitude, from those close to so called "body bounce" frequencies, up to those that would excite tyre cavity resonances. Surface profile 3, having a wavelength of 0.35 m, generates a forcing frequency of 37.0 Hz which would not cause significant perceptible noise at the roadside since the human ear is not sensitive to this frequency. Profiles having a wavelength of around 0.35 meters are therefore particularly beneficial in terms of minimising the external noise disturbance.

Surface profiles 6, 7 and 8 illustrate the effect on forcing frequency of sinusoidal wavelengths that are slightly longer or shorter than the wavelength of 0.35 m. These dimensions were tested using a number of vehicles of different weights and sizes. Measurements of exterior noise were taken using a Bruel & Kjaer 2144 analyser with a type 4149 microphone at 7.5 m from the vehicle centre line at a height of 1.2 m. Crossing speeds were also measured using a radar speed meter and ranged from 15 mph to 40 mph (24 to 64 km/h). Interior noise and vibration were logged with a similar analyser. Interior noise was measured near the driver's head position and vertical vibration was measured using a type 4366 accelerometer attached to the driver's seat rail. The results of these trials indicated that, in general, surfaces with wavelengths smaller than 0.35 began to produce increases in exterior noise as a result of higher forcing frequencies being generated. While the slightly longer wavelengths did not produce a significant increase in exterior noise, they were found to be less effective at creating interior noise and vibration to alert drivers. Generally, surface profile 3 produced the highest levels of interior noise and vibration, without generating significant increases in exterior noise.

Figure 1B:
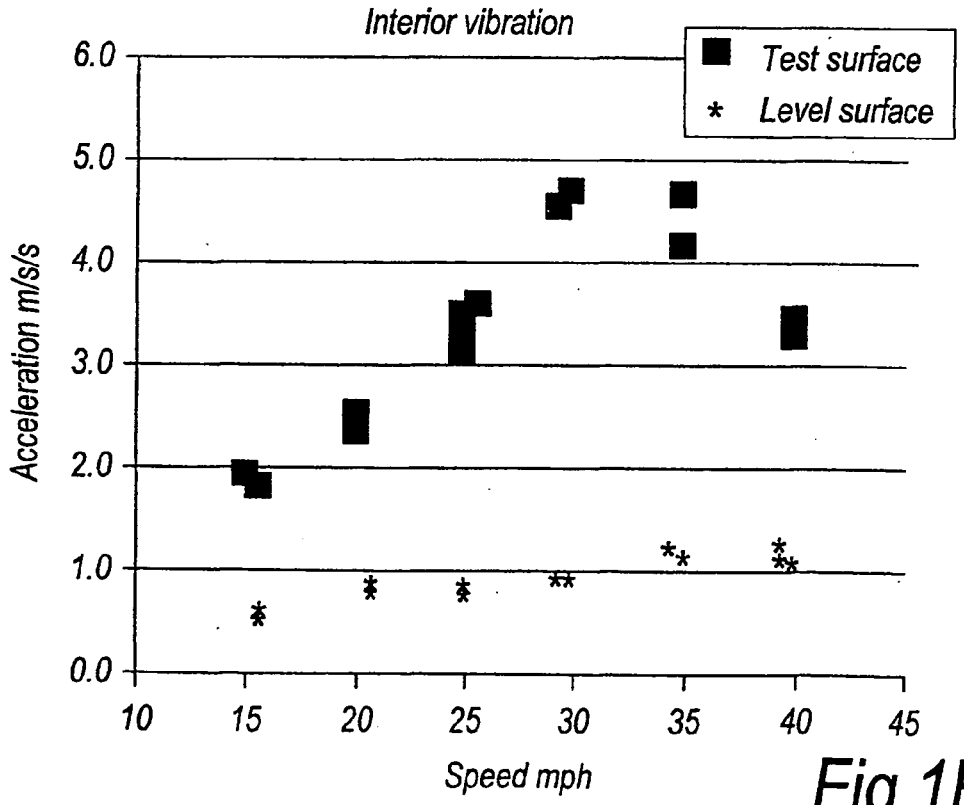

FIG. 1 of the accompanying drawings shows two graphical representations of an experiment to measure interior noise (FIG. 1A) and vibration (FIG. 1B) levels for a mid sized car traversing a traffic calming surface which has been laid according to methods embodying the present invention. The squares represent the noise and vibration measurements taken within the vehicle as it drives over the traffic calming surface, and the dots represent comparative noise measurements when travelling on level ground. It is clear from these figures that the interior noise and vibration levels within a vehicle are significantly increased as a result of the present method.

The first two profiles in the following table enable a comparison to be made for a variation in peak to trough amplitude with a wavelength of 0.35 m. Measurements of external noise were made, and recorded, as before and comparative measurements were also made for vehicles traversing a patterned imprinted surface and a rumble strip with a series of ridges. The measurements of exterior noise for each surface profile are shown in FIGS. 2A to 2D of the accompanying drawings.

| Profile Number | Peak to trough amplitude (mm) | Wavelength (m) | Forcing frequency at 30 mph (Hz) |
|---|---|---|---|
| 1 | 6.62 | 0.35 | 37 |
| 2 | 4.14 | 0.35 | 37 |
| 3 | 7.0 deep pattern | n/a | n/a |
| 4 | 15 high and 230 wide at 1500 spacings | n/a | n/a |

Figure 2A:
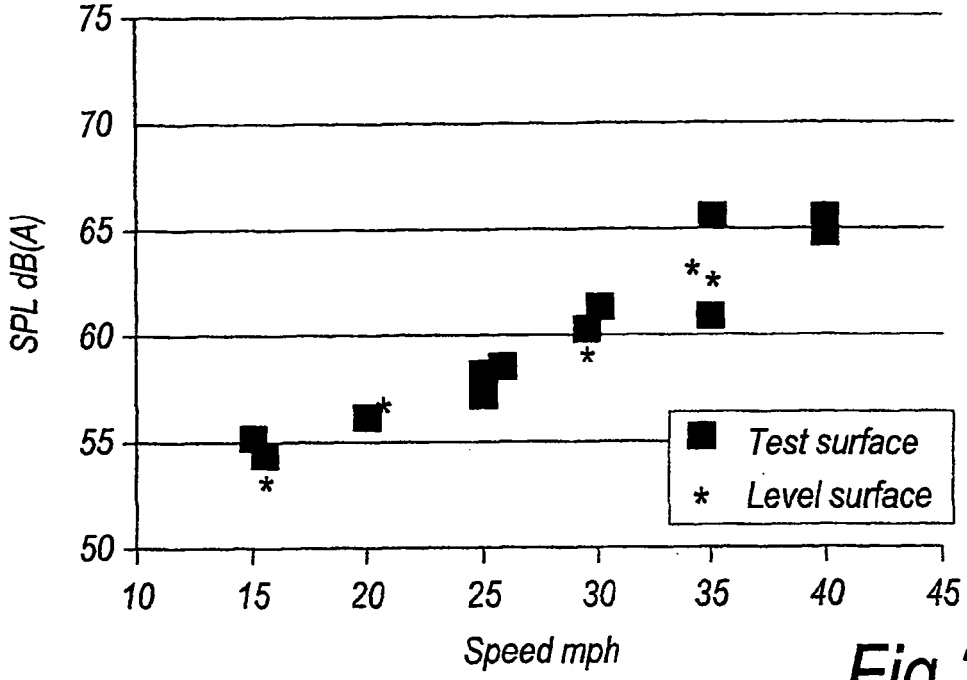
FIG. 2 illustrates exterior noise levels generated by a number of different traffic calming surfaces.
Figure 2B:
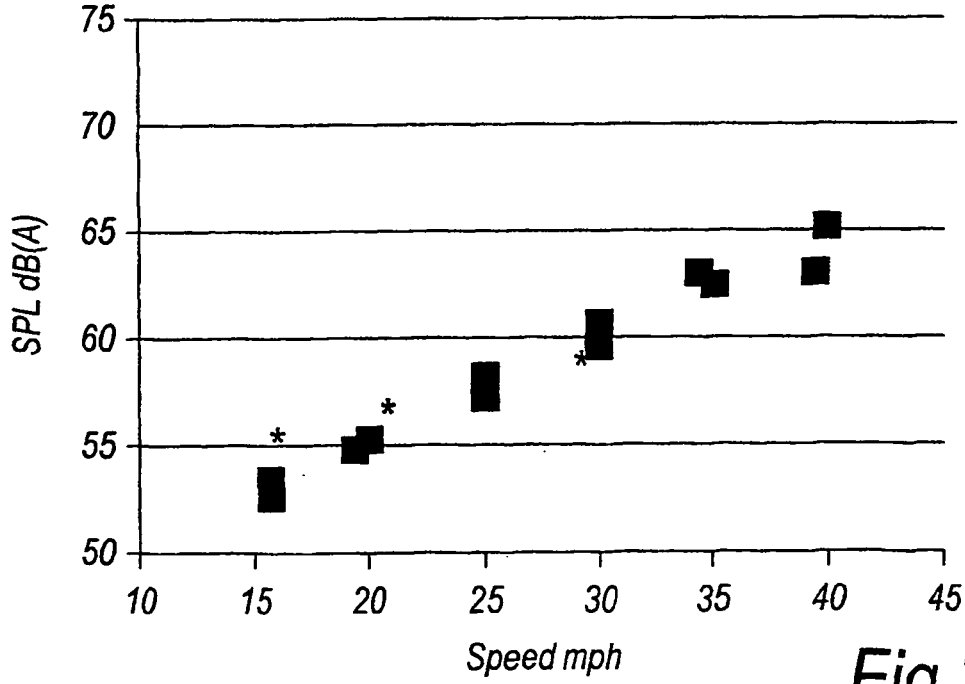
Figure 2C:
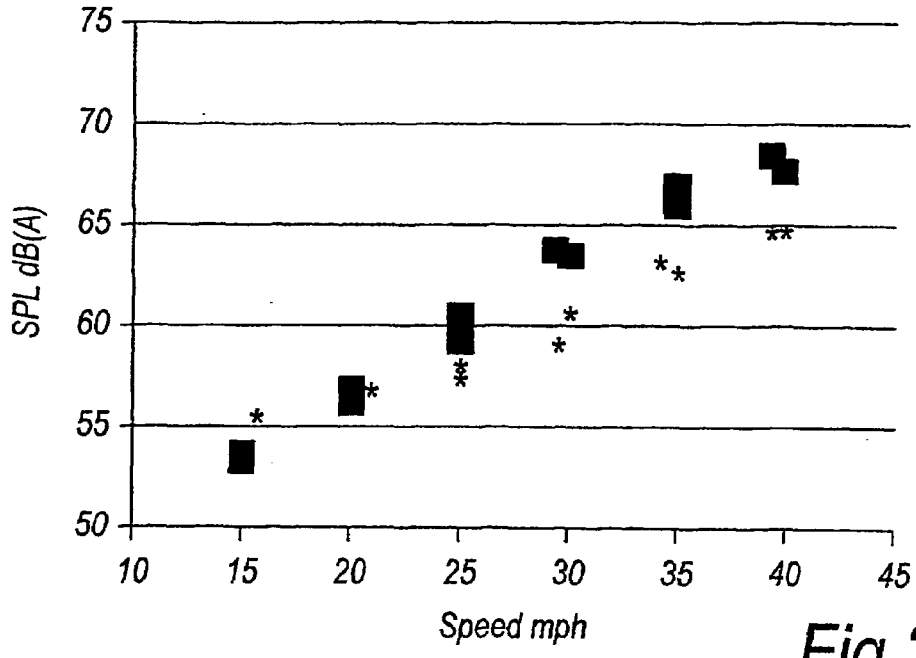
Figure 2D:
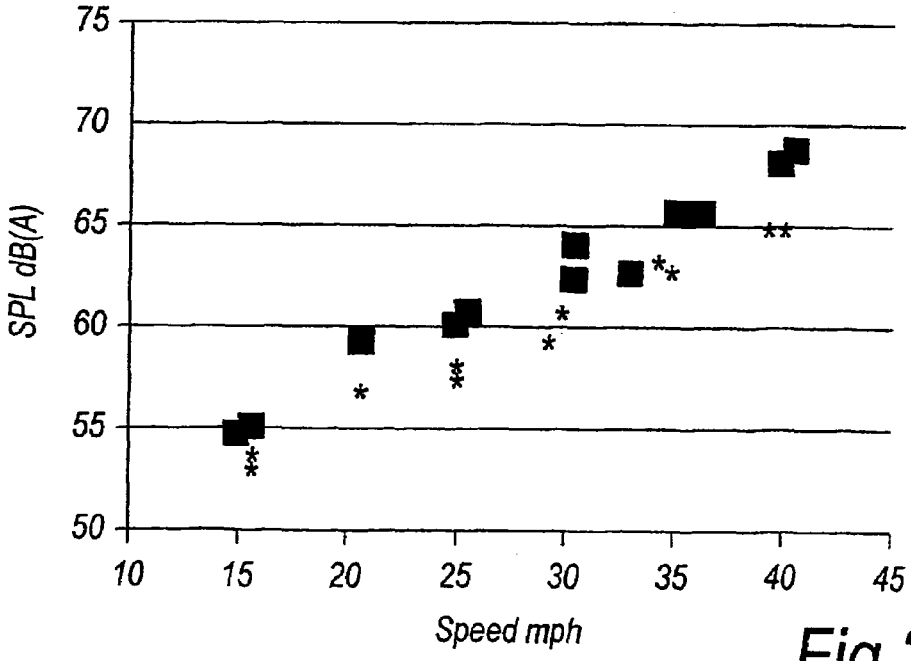

Referring now to FIGS. 2A to 2D which show a graphical representation measurements of external noise generated in the vicinity of a number of traffic calming surfaces. FIGS. 2A and 2B represent noise measurements taken in the vicinity of two traffic calming surfaces which have been laid according to methods embodying the present invention (profiles 1 and 2). As a control, noise levels were also measured for a vehicle travelling along a level road surface and these measurements are shown by the dots on each of the graphs. FIGS. 2C and 2D represent noise measurements taken in the vicinity of vehicles traversing a patterned imprinted surface (FIG. 2C-*profile* 3) and a rumble strip with a series of ridges (FIG. 2D-*profile* 4).

It can be seem from FIGS. 2A and 2B that there was very little increase in external noise compared to the external noise generated by a level road surface. However, the measurements illustrate the substantial increase in noise alongside the imprint pattern and the conventional rumble strip, especially at the higher speeds.

Figure 3:
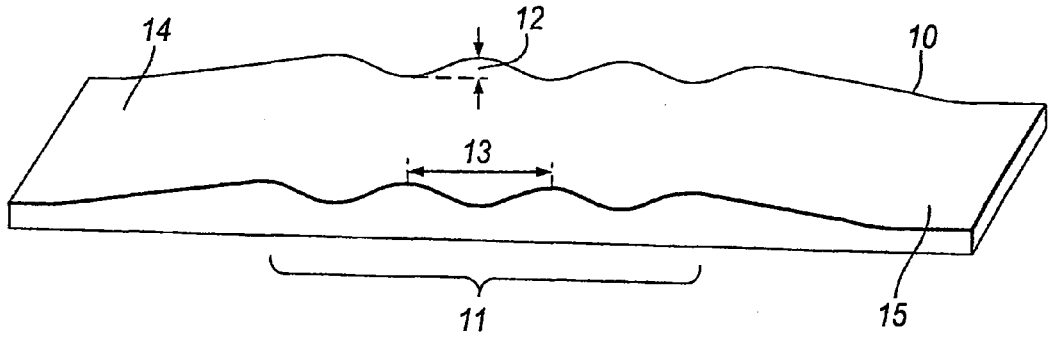
FIG. 3 shows a traffic calming surface which has been laid according to a method embodying the present invention.

FIG. 3 shows an elevational view of a traffic calming surface 10 having a continuous, substantially sinusoidal, profile 11 at the central region thereof. The peak to trough amplitude is denoted by 12 and the wavelength is denoted by 13. The leading and trailing edges 14 and 15 respectively have been laid such they provide a gentle incline for traffic to approach the profiled section. The incline preferably has a uniform gradient over its length. In this example, the incline is designed to take the traffic from the existing surface to the height of the peak over a distance of between 3 m and 5 m. The surface is not drawn to scale, however typical measurements would be a wavelength of 0.35 m and a peak to trough amplitude of 6 mm.

Figure 4:
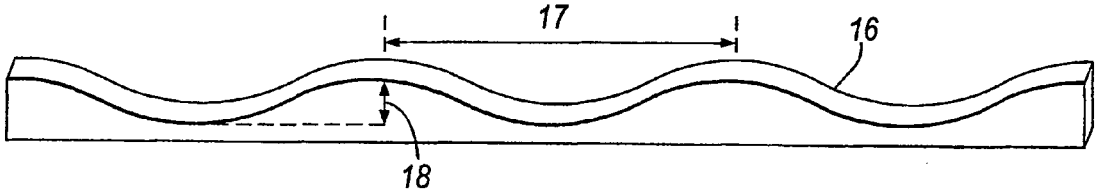
FIG. 4 shows a profiled rail embodying the present invention.

Turning now to FIG. 4, which shows a profiled rail which may be employed according to methods embodying the present invention. The rail 16 is made of aluminium and exhibits a continuous, substantially sinusoidal profile, which extends along the length of the rail. The wavelength of the rail is denoted by 17 and the peak to trough amplitude is denoted by 18. A series of such rails may be laid in a line adjacent to each other, taking care to ensure that the dimension of the wavelength and the peak to trough amplitude are identical. They are secured to the existing road surface by means of bolts and/or glue and/or nails to ensure that they do not slip during the moulding process.

Figure 5:
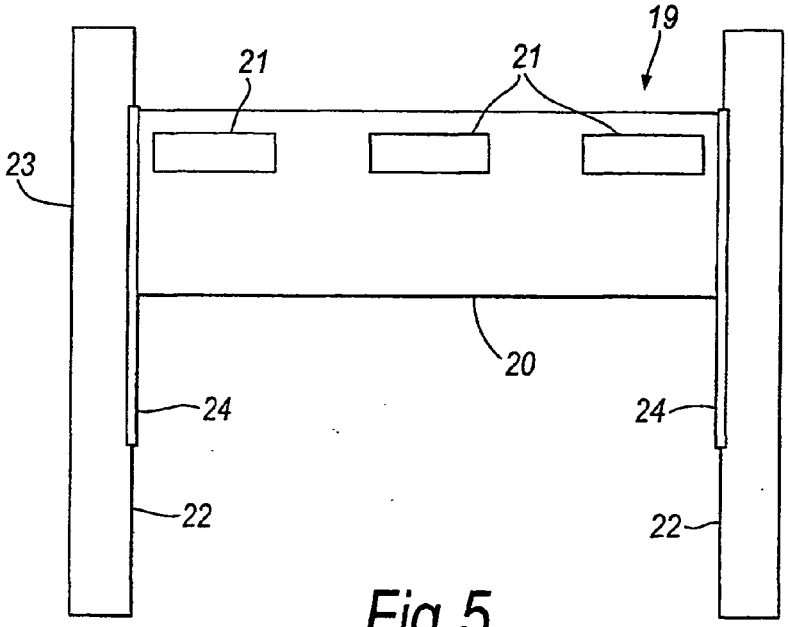
FIG. 5 shows a plan view of the moveable member embodying the present invention taken from above.
Figure 5:
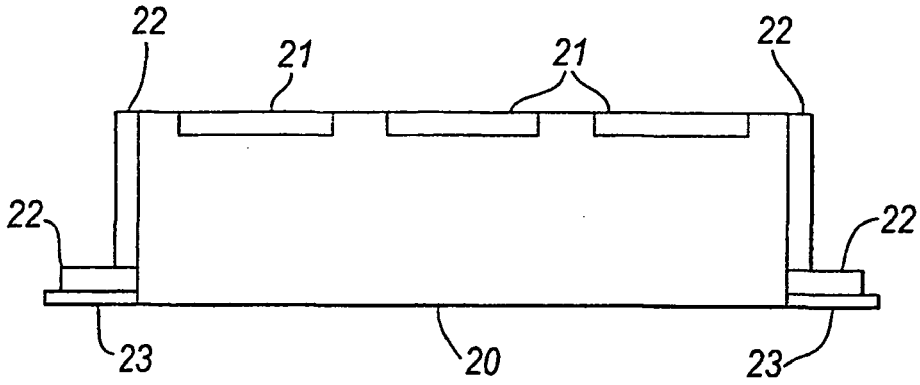
Figure 6:
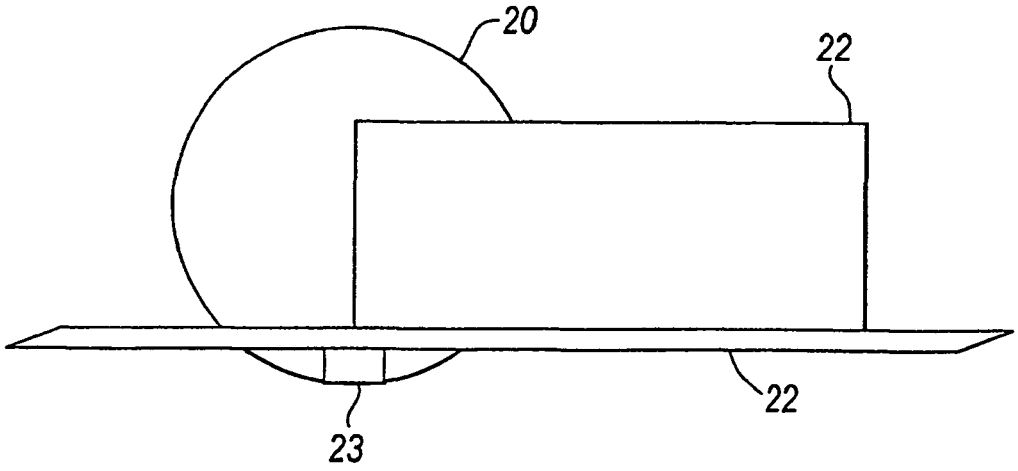
FIG. 6 shows a moveable member embodying the present invention from in front.

FIG. 5 shows a plan view of a moveable member 19 comprising a cylindrical drum 20, having three air vents 21 in the surface thereof, and a pair of runners 22 which are adapted to ride along the upper surface of a rail such as that depicted in FIG. 4. The moveable member is also provided with a pair of spacers 23, which serve to raise the runners to the required height and two side walls 24.

The invention claimed is:

1. A method of laying a traffic calming surface, the method comprising the steps of:

i) depositing molten material on a surface of a road or path;

ii) molding the molten material such that an upper surface thereof has a predetermined continuous, substantially sinusoidal profile which extends along an intended direction of travel;

wherein the material is deposited between at least one pair of substantially longitudinal rails which are positioned on the surface of the road so as to be spaced apart from each other and such that they are substantially aligned with the intended direction of travel, and wherein upper surfaces of the rails have a predetermined continuous, substantially sinusoidal profile which extends along respective lengths of said rails; and wherein the material is molded by means of a moveable member which extends between the rails, and which is moved over the rails in contact with the molten material such that the upper surface of the material is molded to form the continuous sinusoidal profile.

2. A method as claimed in claim 1 wherein the rails are positioned on the ground so as to be mutually parallel.

3. A method as claimed in claim 1 wherein the moveable member defines or exhibits a substantially linear edge which extends between the pair of rails and comes into contact with the molten material as the moveable member is moved across the upper surface of the rails.

4. A method as claimed in claim 1 wherein the moveable member comprises a cylindrical drum.

5. A method as claimed in claim 1 wherein said moveable member is formed of metal.

6. A method as claimed in claim 5 wherein said moveable member is formed of steel.

7. A method as claimed in claim 1 wherein said moveable member is heated.

8. A method as claimed in claim 7 wherein said moveable member is heated to between 300° C. to 550°C.

9. A method as claimed in claim 1 wherein the molten material is deposited in front of the moveable member before the molten material is molded.

10. A method as claimed in claim 9 wherein the material is molded by tamping the molten material deposited between the at least one pair of rails, such that the upper surface of the material forms the continuous, substantially sinusoidal profile.

11. A method as claimed in claim 1 wherein the rails are secured to the surface of the road.

12. A method as claimed in claim 1 wherein the rails are formed of aluminum.

13. A method as claimed in claim 1 wherein the wavelength of the resultant substantially sinusoidal profile is 0.28 m to 0.48 m.

14. A method as claimed in claim 13 wherein the wavelength of the resultant substantially sinusoidal profile is 0.3 m to 0.4 m.

15. A method as claimed in claim 1 wherein the wavelength of the resultant substantially sinusoidal profile is 0.3 5 m.

16. A method as claimed in claim 1 wherein the wavelength of the resultant substantially sinusoidal profile is approximately equal to the contact patch length of a tire.

17. A method as claimed in claim 1 wherein a peak to trough amplitude of the resultant traffic calming surface is 4 mm to 12 mm.

18. A method as claimed in claim 17 wherein the peak to trough amplitude of the resultant traffic calming surface is 6 mm to 7 mm.

19. A method as claimed in claim 1 wherein the resultant traffic calming surface has a length of 5 m to 20 m.

20. A method as claimed in claim 1 wherein the molten material comprises a polymer modified bitumen based compound.

21. A method as claimed in claim 20 wherein the molten material comprises a synthetic bitumen mixed with filler and aggregate.

22. A method as claimed in claim 21 wherein the molten material comprises binder resin, polymer and plasticizer.

23. A method as claimed in claim 1 wherein the molten material comprises concrete or group.

* * * * *